US008844922B2

(12) United States Patent
Ishikawa et al.

(10) Patent No.: US 8,844,922 B2
(45) Date of Patent: Sep. 30, 2014

(54) SHEET PROCESSING APPARATUS THAT CORRECTS LATERAL DEVIATION OF A SHEET

(71) Applicant: Canon Kabushiki Kaisha, Tokyo (JP)

(72) Inventors: Naoki Ishikawa, Kashiwa (JP); Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/888,433

(22) Filed: May 7, 2013

(65) Prior Publication Data

US 2013/0300055 A1 Nov. 14, 2013

(30) Foreign Application Priority Data

May 9, 2012 (JP) ..... 2012-107465
Apr. 26, 2013 (JP) ..... 2013-093780

(51) Int. Cl.
*B65H 9/00* (2006.01)
*B65H 7/10* (2006.01)
*B65H 9/10* (2006.01)

(52) U.S. Cl.
CPC .. *B65H 7/10* (2013.01); *B65H 9/00* (2013.01); *B65H 9/101* (2013.01); *B65H 2301/34* (2013.01); *B65H 2301/3621* (2013.01)
USPC ..... 270/58.27; 271/184; 270/58.11; 270/58.07; 270/58.17

(58) Field of Classification Search
CPC ..... B65H 2301/34; B65H 2301/3621; B65H 9/00; B65H 9/101
USPC ..... 270/58.07, 58.11, 58.12, 58.17, 58.27; 271/184, 227, 228
See application file for complete search history.

(56) References Cited

U.S. PATENT DOCUMENTS 6,907,806 B1 * 6/2005 Okamoto et al. ..... 83/76.8
7,578,498 B2 * 8/2009 Iguchi et al. ..... 270/58.07
8,371,578 B2 * 2/2013 Ishikawa et al. ..... 271/227
8,454,012 B2 * 6/2013 Obuchi et al. ..... 271/252

FOREIGN PATENT DOCUMENTS

JP 2007-001761 A 1/2007

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which enables a sheet to be stopped at a target position with precision even when the sheet is stopped by moving a heavy unit such as a shift unit. A drive unit moves a moving unit so as to move a sheet, which is being conveyed, in a direction perpendicular to a conveying direction of the sheet. An output unit detects movement of the moving unit and output a signal in synchronization with movement of the moving unit. A control unit issues a stop instruction to the drive unit based on a delay time from when a start instruction to the drive unit is issued until when the signal in synchronization with the movement of the drive unit is output, and a target moving amount required for the moving unit to move to a target position.

5 Claims, 13 Drawing Sheets

SHEET PROCESSING APPARATUS THAT CORRECTS LATERAL DEVIATION OF A SHEET

BACKGROUND OF THE INVENTION

1. Field of the Invention

The present invention relates to a sheet processing apparatus that corrects lateral deviation of a sheet that has been conveyed and carries out post processing such as punching and sorting on the corrected sheet.

2. Description of the Related Art

Conventionally, there has been known a technique to correct lateral deviation of a sheet, which has been conveyed from an image forming apparatus, in a width direction perpendicular to a conveying direction in a sheet processing apparatus.

Examples of such a sheet processing apparatus include one which corrects lateral deviation of a sheet in the width direction by detecting a side edge of the sheet, moving the sheet in the width direction, and aligning the side edge of the sheet with a predetermined position (see, for example, Japanese Laid-Open Patent Publication (Kokai) No. 2007-001761). In this conventional sheet processing apparatus, processing such as punching and sorting is carried out on a sheet whose lateral deviation has been corrected.

In the conventional sheet processing apparatus described above, however, a shift unit configured such that guide members and rollers for sheet conveyance move thereon so as to correct for lateral deviation of a sheet in the width direction is used, and hence the shift unit itself is heavy in weight. Moreover, a motor, which is a drive source, and the shift unit are connected together by a belt, and hence there may be cases where operation of the motor and movement of the shift unit are not started in synchronization with each other under the effect of an inertial force due to the weight of the shift unit and the expanding and contracting properties of the belt. In such cases, the travel amount of the shift unit is calculated based on information on a drive signal for the motor, and when based on the calculated amount, it is determined that the shift unit has reached a predetermined position, and the shift unit is stopped, a position at which the shift unit is desired to be stopped and a position at which the shift unit has actually stopped do not match.

Moreover, the amount of delay in the shift unit actually starting operating with respect to a time when the motor starts operating is also dependent on the expanding and contracting properties of the belt, and hence this amount of delay varies according to the distance from a motor shaft to a place at which the belt and the shift unit are fixed. Thus, when the position at which the shift unit stops varies each time the shift unit operates, the amount of delay cannot be uniform.

SUMMARY OF THE INVENTION

The present invention provides a sheet processing apparatus which enable a sheet to be stopped at a target position with precision even when the sheet is stopped by moving a heavy unit such as a shift unit.

Accordingly, a first aspect of the present invention provides a sheet processing apparatus comprising a moving unit configured to move a sheet, which is being conveyed, in a direction perpendicular to a conveying direction of the sheet, a drive unit configured to move the moving unit, an output unit configured to detect movement of the moving unit and output a signal in synchronization with movement of the moving unit, and a control unit configured to determine timing with which the control unit issues an instruction to stop driving to the drive unit based on a delay time from when the control unit issues an instruction to start driving to the drive unit until when the signal in synchronization with the movement of the moving unit is output from the output unit, and a target moving amount required for the moving unit to move to a target position.

Accordingly, a second aspect of the present invention provides a sheet processing apparatus comprising a first detection unit configured to detect a position of a side edge of a sheet in a width direction perpendicular to a conveying direction of the sheet, a moving unit configured to hold the sheet and move the sheet in the width direction, a motor configured to move the moving unit in the width direction via a driving force transmitting member, a second detection unit configured to detect movement of the moving unit, and a control unit configured to control how the motor drives based on the position detected by the first detection unit so that the side edge of the sheet moves to a reference position in the width direction, and determine timing with which the motor stop driving according to a drive amount of the motor from when the motor start driving until when the second detection unit detects that the moving unit starts driving.

Accordingly, a third aspect of the present invention provides a sheet processing apparatus comprising a first detection unit configured to detect a position of a side edge of a sheet in a width direction perpendicular to a conveying direction of the sheet, a moving unit configured to hold the sheet and move the sheet in the width direction, a first motor configured to move the moving unit in the width direction via a driving force transmitting member, a second motor configured to move the first detection unit in the width direction, a second detection unit configured to detect movement of the moving unit, and a control unit configured to control how the first motor drives based on the position detected by the first detection unit so that the side edge of the sheet moves to a reference position in the width direction, wherein the control unit controls the second motor so that the first detection unit moves to a first position which is different from the reference position after the first detection unit detects the position of the side edge of the sheet, controls the first motor so that the side edge of the sheet moves to a second position opposing to the reference position with respect to the first position, further controls the first motor so that the side edge of the sheet moves from the second position toward the reference position, and determines timing with which the first motor stops driving according to a drive amount of the first motor from when the first motor starts driving until when the second detection unit detects that the moving unit starts moving.

According to the present invention, the sheet can be stopped at the target position with precision even when the sheet is stopped by moving a heavy unit such as a shift unit.

Further features of the present invention will become apparent from the following description of exemplary embodiments (with reference to the attached drawings).

DESCRIPTION OF THE EMBODIMENTS

The present invention will now be described in detail with reference to the drawings showing embodiments thereof.

Figure 1:
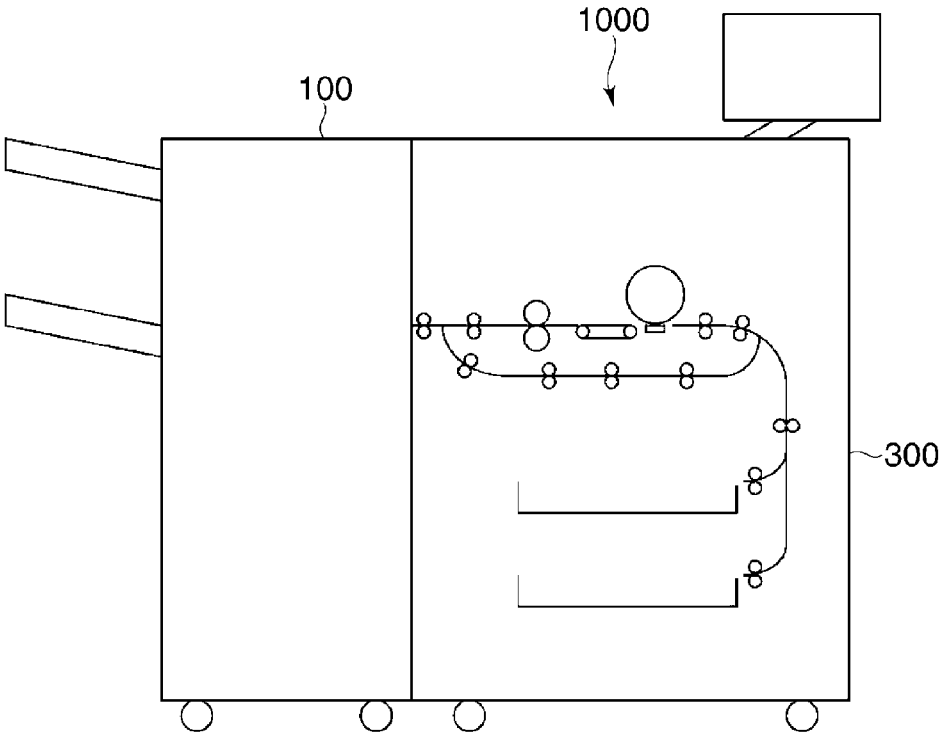
FIG. 1 is a partial cross-sectional view schematically showing an arrangement of an image forming system to which a sheet processing apparatus according to a first embodiment of the present invention is applied.

FIG. 1 is a partial cross-sectional view schematically showing an arrangement of an image forming system 1000 to which a sheet processing apparatus according to a first embodiment of the present invention is applied.

Referring to FIG. 1, the image forming system 1000 is comprised of an image forming apparatus 300 and a finisher 100 which is a sheet processing apparatus.

The image forming apparatus 300 conveys a sheet, forms an image on the conveyed sheet, conveys the sheet with the image formed thereon, and discharges the sheet to the outside. Concrete examples of the image forming apparatus 300 include a copier, a facsimile, a printer, and a multifunction peripheral that incorporates the functionality of these devices in one, but the image forming apparatus 300 is not limited to any one of them, and any of them may be used.

The finisher 100 carries out various types of post-processing including punching, stapling, and sorting on a sheet with an image formed thereon discharged from the image forming apparatus 300. Thus, in the present embodiment, because the image forming apparatus 300 and the finisher 100 are configured as separate units, and the finisher 100 is optional, the image forming apparatus 300 can be used alone. The finisher 100, however, is not limited to this, but the image forming apparatus 300 and the finisher 100 may be configured as an integral unit.

Figure 2:
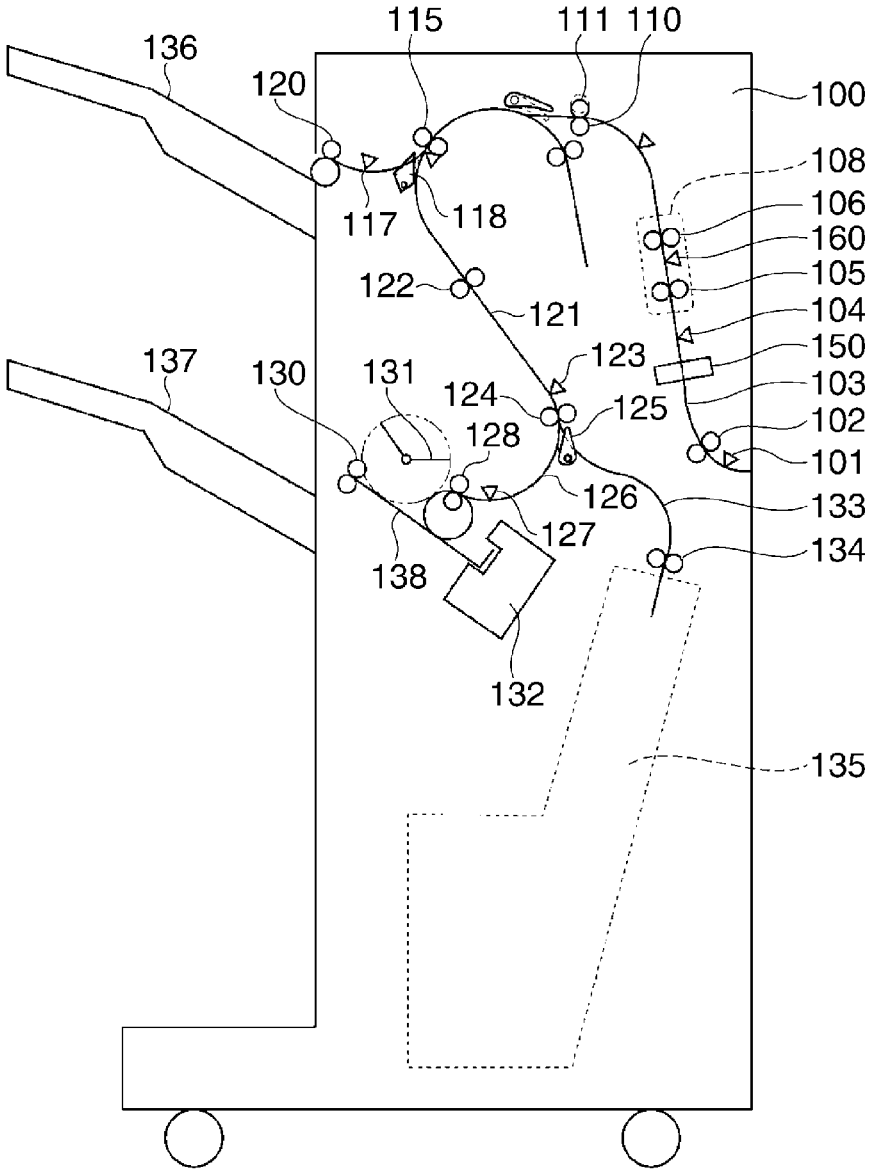
FIG. 2 is a cross-sectional view showing in detail an arrangement of a finisher appearing in FIG. 1.

FIG. 2 is a cross-sectional view showing in detail an arrangement of the finisher 100.

Referring to this figure, a sheet discharged from the image forming apparatus 300 is delivered to an entrance roller pair 102 of the finisher 100. At the same time, delivery timing of the sheet is detected by an entrance sensor 101. While the sheet conveyed by the entrance roller pair 102 is passing through a conveying path 103, a position of a side edge of the sheet is detected by a side edge sensor 104. Based on the position of the side edge of the sheet detected by the side edge sensor 104, an amount of lateral deviation of the sheet relative to a predefined position of the side edge of the sheet is determined.

While the sheet is being conveyed by shift roller pairs 105 and 106 after the amount of lateral deviation of the sheet is determined, a shift unit 108 (moving unit) moves by a predetermined amount toward the front side or the rear side (in a with direction of the sheet) to shift the sheet. Here, "the front side" and "the rear side" respectively correspond to a near side and a far side in the depth direction of the image forming system 100 when viewed in the orientation shown in FIG. 1. Also, "the width direction of the sheet" means a direction perpendicular to a conveying direction of the sheet (the same shall apply hereafter).

On the other hand, when the sheet is subjected to punching using a punch unit 150, the sheet the side edge of which is corrected to the predefined position by the shift unit 108 is stopped at a punching position, and punching is carried out on the sheet. The shift unit 108 is equipped with a shift unit pass sensor 160 that detects whether or not the sheet has passed the shift unit 108. Based on sensor output from the shift unit pass sensor 160, a position of the sheet in the conveying direction is detected, and conveyance of the sheet is controlled so that the sheet can stop at the punching position. Then, when the punched sheet is to be subjected to sorting, the shift unit 108 is caused to move again by a predetermined amount toward the front side or the rear side to shift the sheet.

The sheet is then conveyed by a conveying roller 110 and a separating roller 111 and further conveyed by a buffer roller pair 115. When the sheet is to be discharged onto an upper discharged sheet tray 136, a flapper 118 is reoriented by a solenoid or the like, not shown, so as to guide the sheet to an upper conveying path 117. As a result, the sheet is discharged onto the upper discharged sheet tray 136 by an upper sheet discharging roller 120.

On the other hand, when the sheet is not to be discharged onto an upper discharged sheet tray 136, the flapper 118 is reoriented so as to guide the sheet to a bundle conveying path 121. The sheet is then caused to pass through the bundle conveying path 121 by a buffer roller pair 122 and a bundle conveying roller pair 124. Thereafter, when the sheet is to be subjected to saddle stitching, a flapper 125 is reoriented by a solenoid or the like, not shown, so as to guide the sheet to a saddle path 133. The sheet is further guided to a saddle stitching unit 135 by a saddle stitching entrance roller pair 134 and subjected to saddle stitching. Saddle stitching, which is a common process, is not an essential part of the present invention, and therefore, detailed description thereof is omitted.

On the other hand, when the sheet conveyed from the bundle conveying roller pair 124 is to be discharged onto a lower discharged sheet tray 137, the flapper 125 is reoriented so as to guide the sheet to a lower path 126. The sheet is then discharged onto a processing tray 138 by a lower sheet discharging roller pair 128. A plurality of sheets, that is, a sheet bundle stacked on the processing tray 138 is subjected to alignment on the processing tray 138 by a paddle 131, a knurling belt (not shown) or the like. The aligned sheet bundle is subjected to stapling by a stapler 132 as necessary and then discharged onto the lower discharged sheet tray 137 by a bundle sheet discharging roller pair 130.

Figure 3:
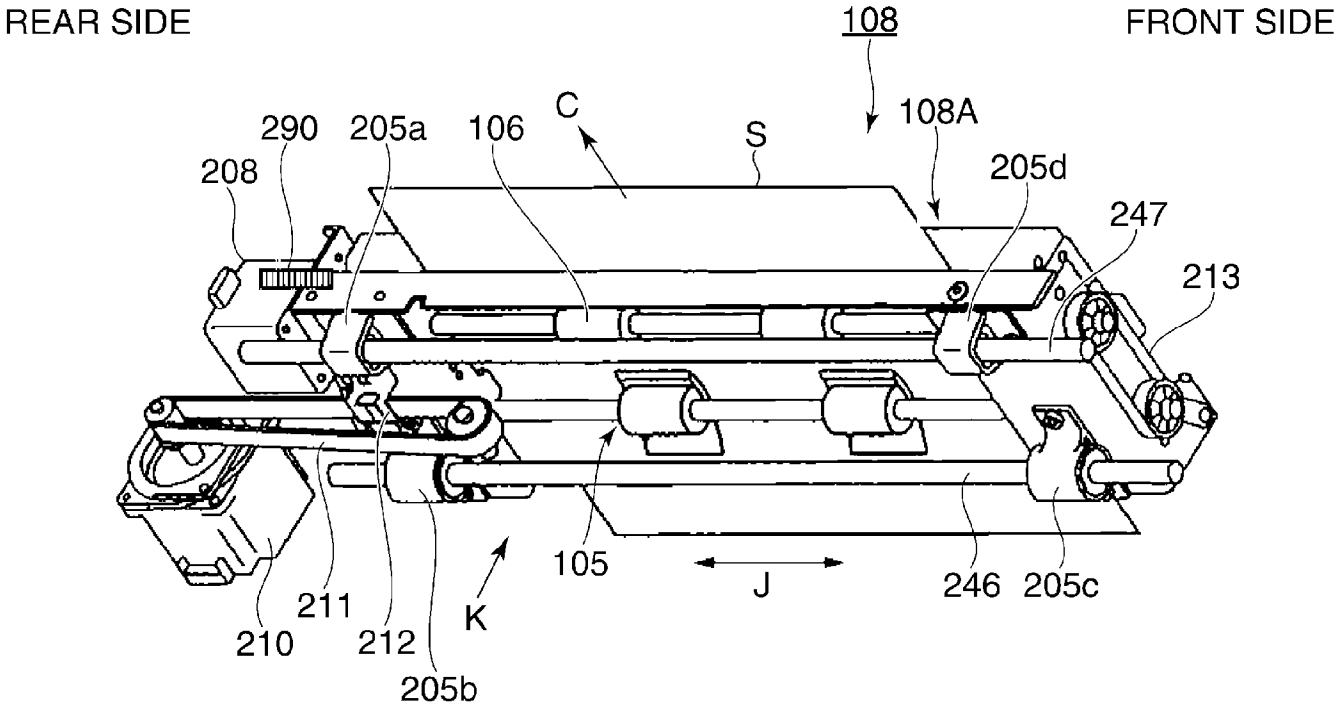
FIG. 3 is a perspective view showing an appearance of a shift unit appearing in FIG. 2.
Figure 4:
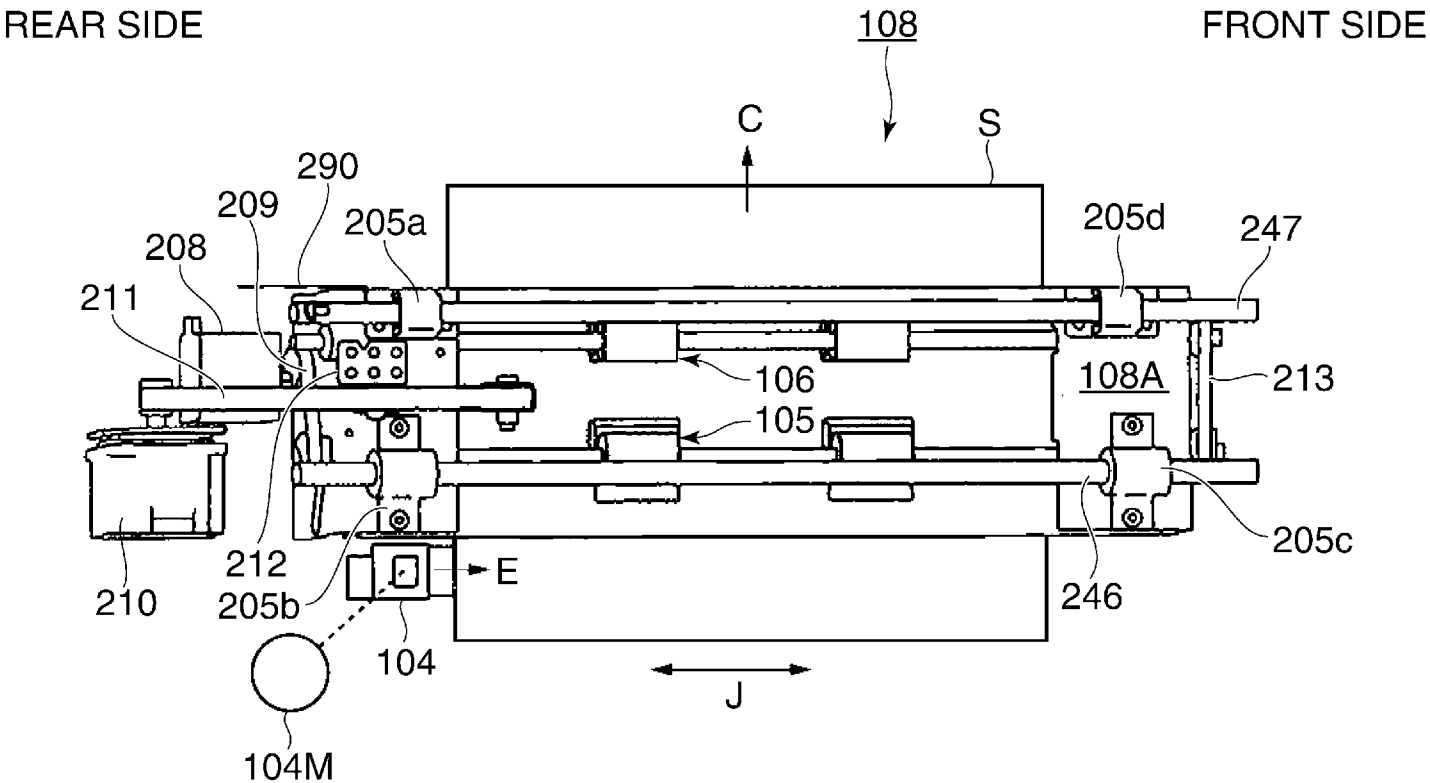
FIG. 4 is a view of the shift unit appearing in FIG. 3 as viewed from a direction indicated by an arrow K.

FIG. 3 is a perspective view showing an appearance of the shift unit 108. FIG. 4 is a view of the shift unit appearing in FIG. 3 as viewed from a direction indicated by an arrow K. In FIGS. 3 and 4, a left side corresponds to a rear side of the sheet processing apparatus, and a right side corresponds to a front side of the sheet processing apparatus.

Slide rails 246 and 247 are fixed to the finisher 100. Slide bushes 205*a* and 205*d* move on the slide rail 247, and slide bushes 205*b* and 205*c* move on the slide rail 246. A frame 108A of the shift unit 108 is supported by the slide bushes 205*a* to 205*d* and reciprocates in directions indicated by an arrow J. The directions indicated by the arrow J correspond to the width direction of the sheet.

The frame 108A is provided with a shift conveying motor 208 and the shift roller pairs 105 and 106. The shift conveying motor 208 rotates the shift roller pair 105 through a drive belt 209 as a driving force transmitting member. The shift roller pair 105 rotates the shift roller pair 106 through a drive belt 213.

The finisher 100 is provided with the side edge sensor 104 and a shift motor 210. In the present embodiment, a stepper motor is adopted as the shift motor 210. When a finisher controller 501 (see FIG. 5, referred to later) outputs a signal indicative of an instruction to move the frame 108A, the shift motor 210 (drive unit) starts rotating to circulate the drive belt 211. The drive belt 211 is connected to the frame 108A via a connecting member 212, and hence the frame 108A is moved in the directions indicated by the arrow J by the circulating drive belt 211. The sheet is shifted in the width direction by the frame 108A moving when the sheet S is sandwiched between the shift roller pairs 105 and 106.

Also, a linear encoder 290 is attached to the shift unit 108, and a linear encoder sensor 170 (see FIG. 5, although not shown in FIGS. 3 and 4) is fixed to the finisher 100 at such a position as to be able to detect the linear encoder 290. The linear encoder 290 and the linear encoder sensor 170 are capable of outputting a signal in synchronization with movement of the shift unit 108 and detecting the travel amount of the shift unit 108 (they act as a first detection unit).

The side edge sensor 104, which is an optical sensor, moves in a direction (direction indicated by an arrow E in FIG. 4) perpendicular to the conveying direction of the sheet S to detect a side edge of the sheet S. The movement of the side edge sensor 104 is caused by a pulse motor 104M. It should be noted that the direction indicated by the arrow E is the same as the direction indicated by the arrow J.

Figure 5:
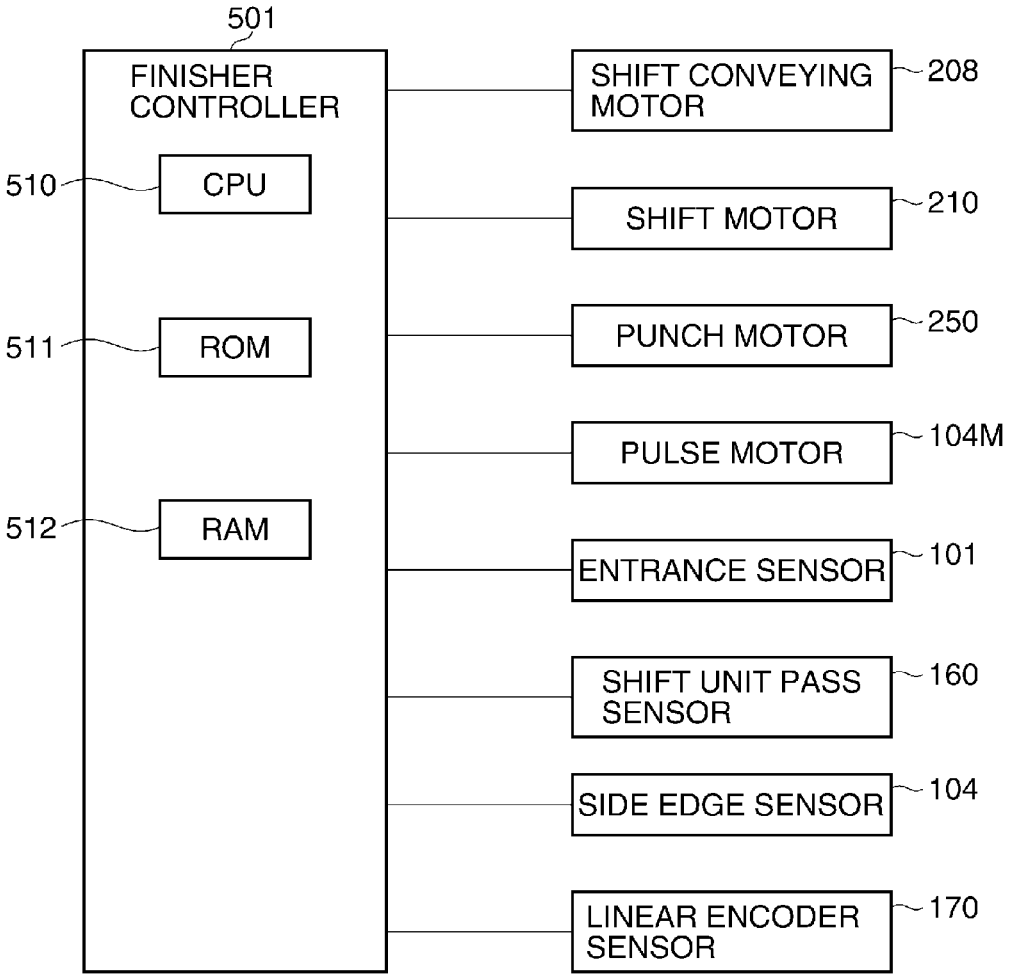
FIG. 5 is a block diagram schematically showing a control arrangement of a controller of the finisher appearing in FIG. 2.

FIG. 5 is a block diagram schematically showing a control arrangement of a controller (hereafter referred to as "the finisher controller") 501 of the finisher 100.

The finisher controller 501 has a CPU 510, a ROM 511, and a RAM 512. The CPU 510 controls various actuators by executing control programs stored in the ROM 511. As described earlier, the finisher 100 has the shift conveying motor 208, the shift motor 210, the punch motor 250, the pulse motor 104M, and so on. It should be noted that the various actuators are controlled based on sensor output from various sensors, and accordingly, various sensors are connected to the finisher controller 501, and the finisher controller 501 is configured to be capable of obtaining sensor output from the various sensors. In the example shown in the figure, the entrance sensor 101, the side edge sensor 104, the shift unit pass sensor 160, and the linear encoder sensor 170 are connected to the finisher controller 501.

Referring now to FIGS. 6A to 10, a detailed description will be given of a control process carried out by the finisher 100 arranged as described above.

Figure 6A:
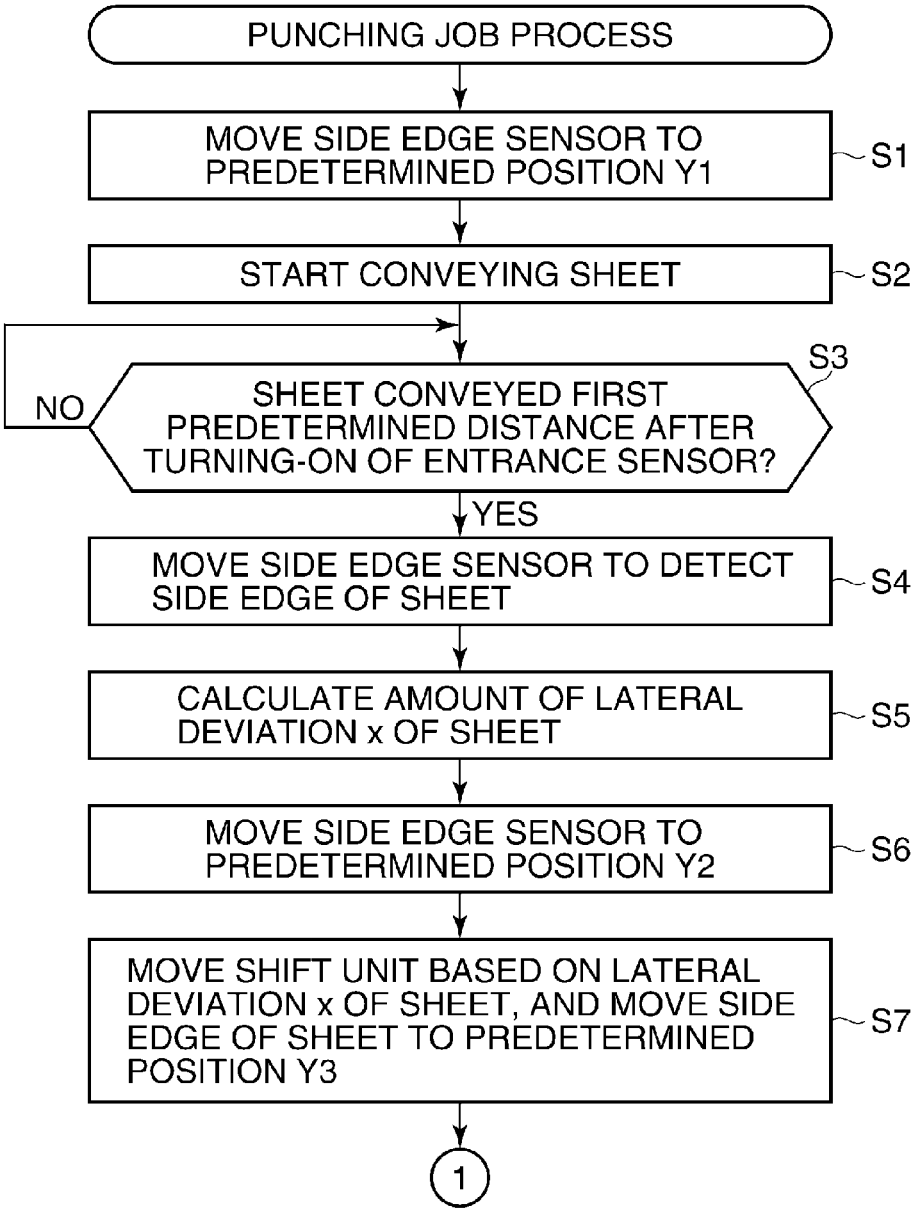
FIGS. 6A and 6B are flowcharts showing the procedure of a punching job process carried out by the finisher appearing in FIG. 2, and more particularly by a CPU of the finisher controller appearing in FIG. 2.
Figure 6B:
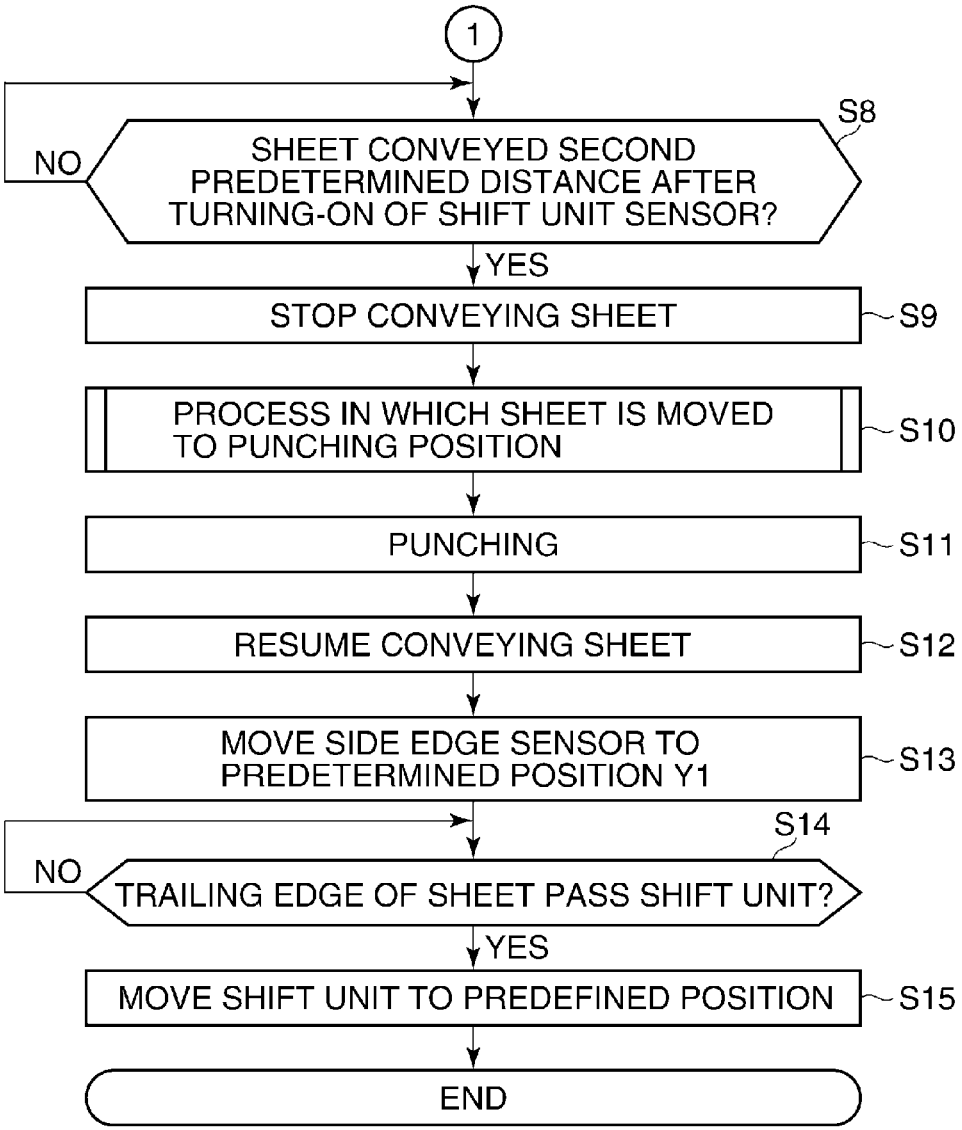

FIGS. 6A and 6B are flowcharts showing the procedure of a punching job process carried out by the finisher 100 appearing in FIG. 2, and more particularly by the CPU 510 of the finisher controller 501 appearing in FIG. 2.

When the punching job process is started, first, the CPU 510 is responsive to a notification of the sheet S being conveyed from the image forming apparatus 300, for causing the side edge sensor 104 to move to a first predetermined position Y1 (see FIG. 8, referred to later), which is a sheet end position when there is no lateral deviation of the sheet S, and stand by (step S1). It should be noted that the first predetermined position Y1 varies with sheet sizes and is referred to as a reference position (target position) of the side edge of the sheet.

Next, the CPU 510 receives the sheet S, which has been conveyed from the image forming apparatus 300, by the entrance roller 101 as described above and conveys the sheet S in the finisher 100 (step S2).

The CPU 510 then determines whether or not the sheet S has been conveyed a first predetermined distance after the sheet S was detected by the entrance sensor 101 (the entrance sensor 101 is on) (step S3). The first predetermined distance is a distance which is required for a leading end of the sheet S to pass the side edge sensor 104. When, as a result of the determination, the sheet S has not been conveyed the first predetermined distance, the CPU 510 waits until the sheet S has been conveyed the first predetermined distance (step S3). On the other hand, when the sheet S has been conveyed the first predetermined distance, the CPU 510 causes the pulse motor 104M to move the side edge sensor 104 in the width direction of the sheet S to detect a side edge of the sheet S (step S4) and determines the amount of lateral deviation x of the sheet S (step S5). Thereafter, the CPU 510 causes the side edge sensor 104 to move to a second predetermined position Y2 (first position), which is at a predetermined distance $\alpha$ behind the first predetermined position Y1, and stand by (step S6). In particular, the side edge sensor 104 moves to the second predetermined position Y2 to determine timing with which the shift motor 210 stops generating the drive pulses, as described later.

Figure 8:
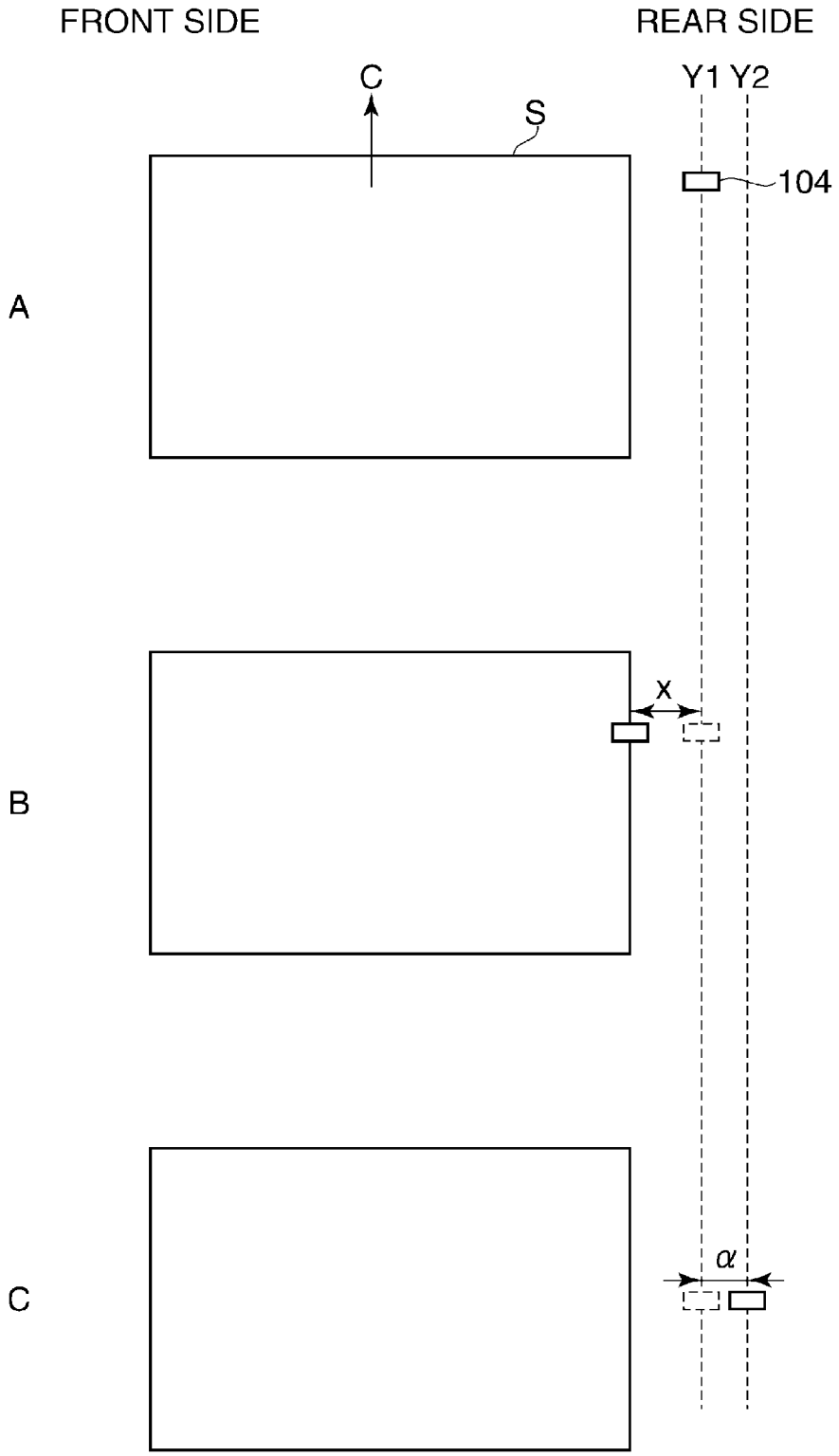
FIG. 8 is a view useful in explaining operation of a side edge sensor before and after the amount of lateral deviation of a sheet is determined.

FIG. 8 is a view useful in explaining operation of the side edge sensor 104 before and after the amount of lateral deviation x of the sheet S is determined.

FIG. 8A shows an example of the positional relationship between the sheet S and the side edge sensor 104 in a case where the sheet S has been conveyed the first predetermined distance, and shows a state in which a side edge of the sheet S on the rear side has not reached a detecting position of the side edge sensor 104, and the side edge sensor 104 has not detected the sheet S. In this state, the CPU 510 moves the side edge sensor 104 toward the front side (leftward as viewed in the figure) so that the side edge sensor 104 can detect the side edge of the sheet S.

On the other hand, conversely to FIG. 8A, when the side edge sensor 104 has detected the sheet S, the CPU 510 moves the side edge sensor 104 toward the rear side (rightward as viewed in the figure) so that the side edge sensor 104 can detect the side edge of the sheet S.

By moving the side edge sensor 104 in the above described way, the side edge of the sheet S is detected while the sheet S is being conveyed.

FIG. 8B shows a state in which the side edge sensor 104 has detected the sheet S at a position reached by the side edge of the sheet S after moving toward the front side by the amount of lateral deviation x from the first predetermined position Y1. The CPU 510 calculates and determines the amount of lateral deviation x of the sheet S according to information on the distance by which the side edge sensor 104 has moved from the first predetermined position Y1, at which the side edge sensor 104 was at rest, to the position at which the side edge of the sheet S has been detected. Specifically, the amount of lateral deviation x of the sheet S is calculated according to an equation (1) below.

$$x=p\times s \quad (1)$$

where "p" represents the number of pulses supplied to the pulse motor 104M until the side edge of the sheet S is detected, and "s" represents the amount by which the side edge sensor 104 advances per pulse.

FIG. 8C shows a state in which the side edge sensor 104 has moved to the second predetermined position Y2 after the side edge of the sheet S was detected. Namely, FIG. 8C shows a position of the side edge sensor 104 after the process in the step S6 described above is carried out.

Referring again to FIG. 6A, based on the amount of lateral deviation x of the sheet calculated in the step S5 described above, the CPU 510 causes the shift motor 210 to move the shift unit 108 in the width direction of the sheet S so that the sheet S can move a predetermined distance β toward the rear side (step S7). As a result, the side edge of the sheet S moves to a third predetermined position Y3 (second position) which is at the predetermined distance β behind the second predetermined position Y2.

Figure 7:
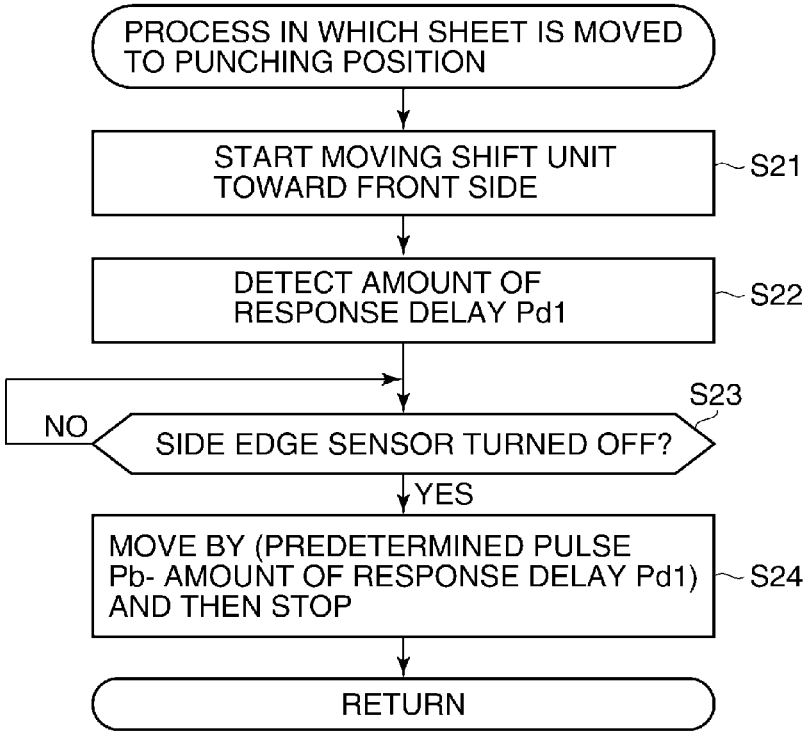
FIG. 7 is a flowchart showing in detail the procedure of a sheet moving process in FIG. 6B in which a sheet is moved to a punching position.
Figure 9:
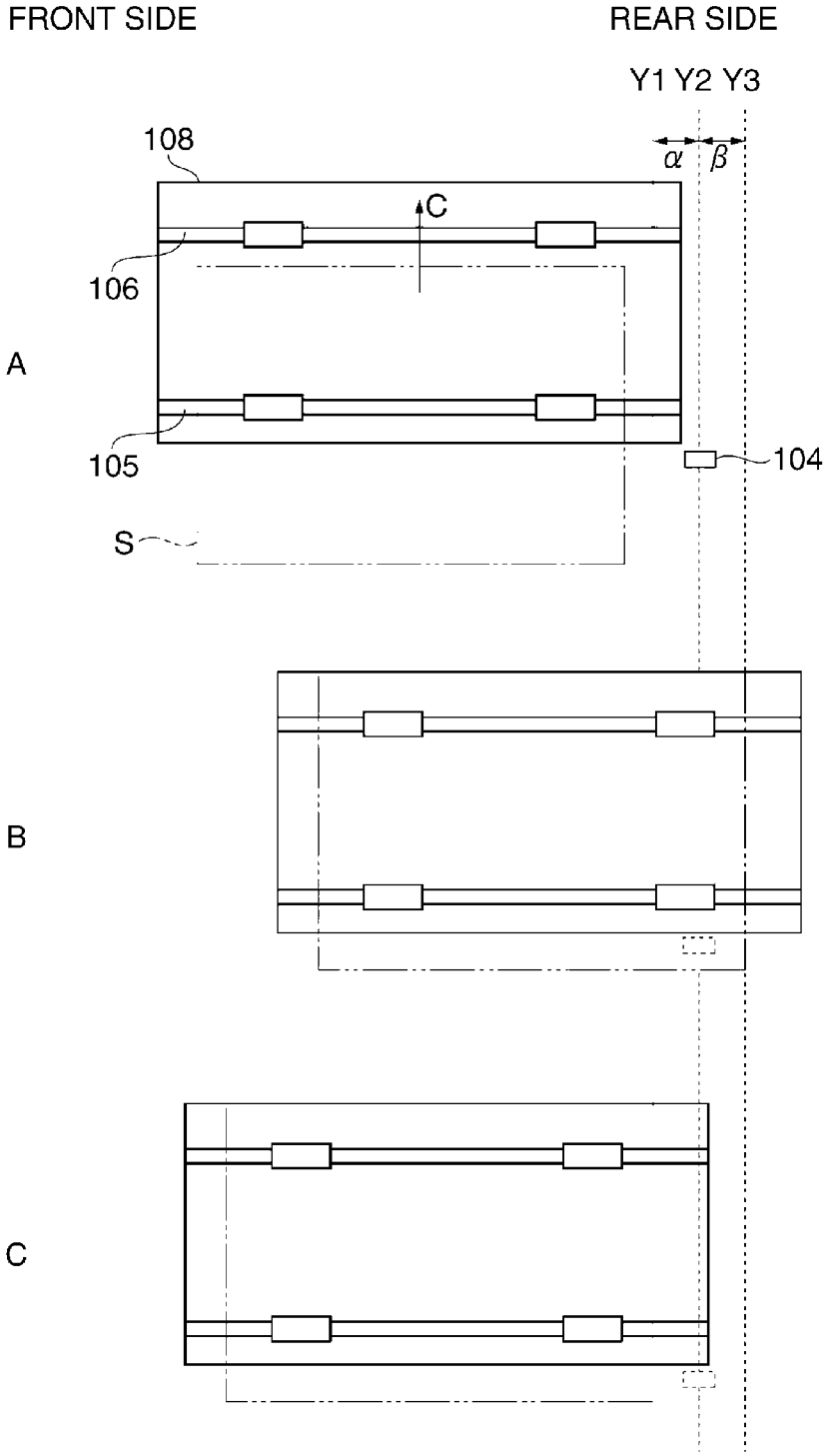
FIG. 9 is a view showing positions of the shift unit in a direction perpendicular to a sheet conveying direction after each of processes in steps S6, S7, and S10 in FIG. 7 is carried out.

FIG. 9 is a view showing positions of the shift unit 108 in a direction perpendicular to the conveying direction C of the sheet S after each of the processes in the steps S6, S7, and S10 in FIG. 7 is carried out.

FIG. 9A shows a position of the shift unit 108 after the process in the step S6 is carried out. FIG. 9A shows the shift unit 108 drawn in a manner being superposed on top of FIG. 8C, and therefore description thereof is omitted.

FIG. 9B shows a position of the shift unit 108 after the process in the step S7 is carried out. As shown in FIG. 9B, when calculation of the amount of lateral deviation x of the sheet S is completed, the shift unit 108 moves until the side edge of the sheet S reaches the third predetermined position Y3, which is at the predetermined distance β behind the second predetermined position Y2, and then stops. The third predetermined position Y3 is in a position opposing to the first predetermined position Y1 with respect to the second predetermined position Y2. The side edge sensor 104 moves to the third predetermined position Y3 to detect a side edge of the sheet S which moves toward the first predetermined position Y1 in a case where the side edge of the sheet S is detected at the second predetermined position Y2 by moving the shift unit 108. At a time point at which the shift unit 108 stops at the third predetermined position Y3, the side edge sensor 104 has already detected the sheet S. Namely, the side edge sensor 104 is in an on state.

FIG. 9C shows a position of the shift unit 108 after the process in the step S10, to be described later, is carried out. Therefore, description of FIG. 9C is not given here, but will be given later together with description of the process in the step S10.

Referring again to FIG. 6B, the CPU 510 determines whether or not the sheet S has been conveyed a second predetermined distance since the sheet S was detected by the shift unit pass sensor 160 (the shift unit pass sensor 160 was turned on) (step S8). The second predetermined position Y2 is a distance required for the sheet S to reach the punching position of the punching unit 150. When, as a result of the determination, the sheet S has not been conveyed the second predetermined distance, the CPU 510 waits until the sheet S has been conveyed the second predetermined distance (step S8). On the other hand, when the sheet S has been conveyed the second predetermined distance, the CPU 510 stops conveying the sheet S (step S9).

the CPU 510 then carries out a sheet moving process in which it moves the sheet S to a punching position (step S10).

FIG. 7 is a flowchart showing in detail the procedure of the process in the step S10 in FIG. 6B in which the sheet S is moved to the punching position.

Referring to this figure, first, the CPU 510 starts outputting (starts driving) a drive signal for driving the shift motor 210 (hereafter referred to as "the shift motor drive signal") to the shift motor 210, thus causing the shift unit 108 to start moving toward the front side (step S21). As a result, the sheet S starts moving toward the front side. However, even when instructed to start moving, the shift unit 108 does not immediately start moving, but starts moving after elapse of a predetermined delay time, and hence the sheet S as well moves starting after elapse of the predetermined time delay. It should be noted that the shift motor drive signal is comprised of pulse signals (see FIG. 10).

Figure 10:
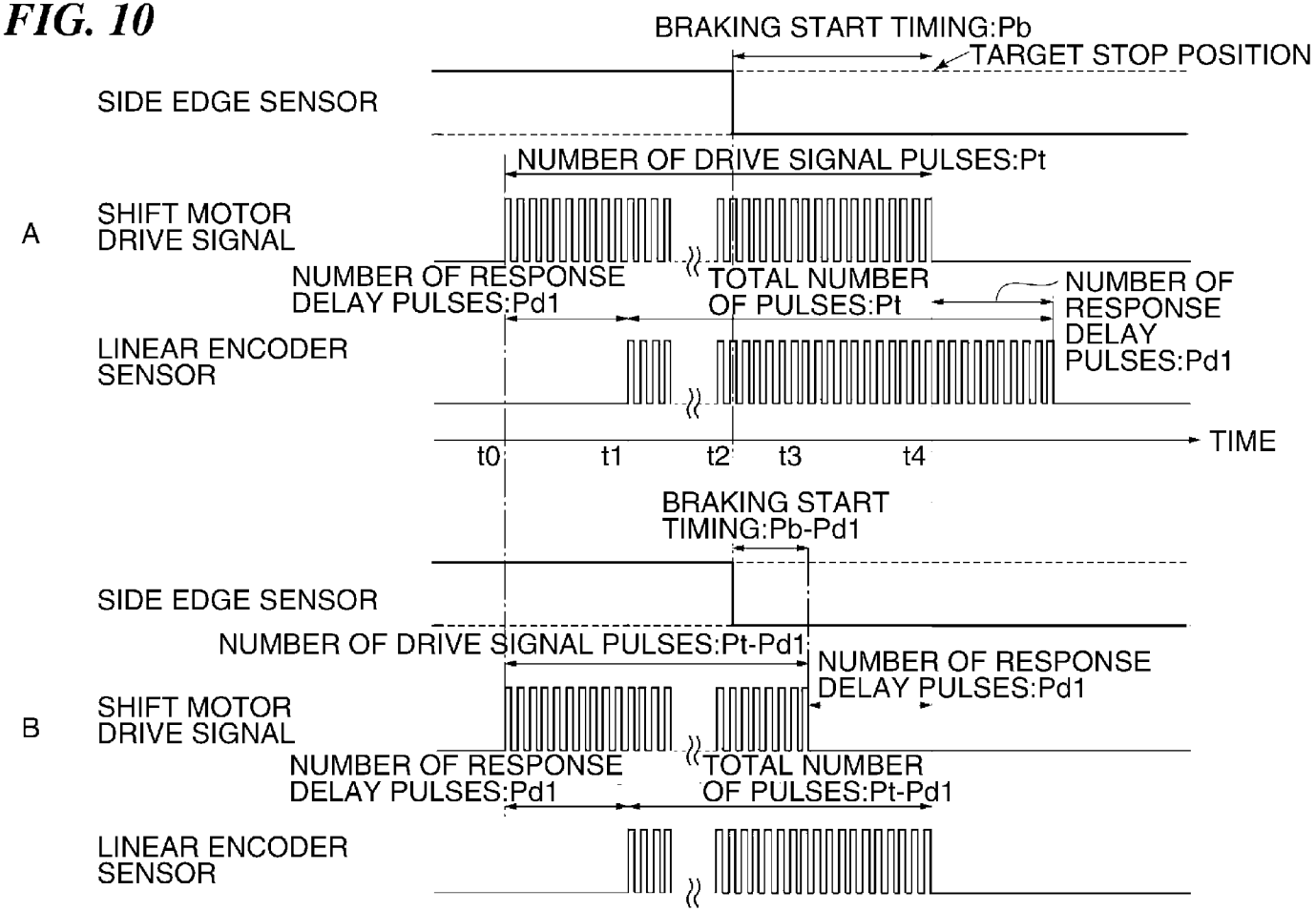
FIG. 10 is a timing chart showing timing with which a shift motor drive signal is output.

FIG. 10 is a timing chart showing timing with which the shift motor drive signal is output. FIG. 10, timing with which a conventional finisher outputs the shift motor drive signal (FIG. 10A) as well as timing with which the finisher 100 according to the present embodiment outputs the shift motor drive signal (FIG. 10B). In this figure, output of the shift motor drive signal is started at a time to.

Referring again to FIG. 7, the CPU 501 detects the amount of response delay Pd1 from when outputting of the shift motor drive signal is started to when start of movement of the shift unit 108 is detected by the linear encoder sensor 170 (step S22). As shown in FIG. 10, the shift motor drive signal is formed of pulse signals with a predetermined period, and hence the amount of response delay Pd1 is detected as the number of pulses. Thus, the amount of response delay Pd1 will hereafter be referred to as "the number of response delay pulses Pd1". It should be noted that in FIG. 10, the period of the shift motor drive signal is equal to that of a sensor output signal from the linear encoder sensor 170. After output of the shift motor drive signal is started, the CPU 501 counts the number of pulses of the shift motor drive signal until when output of the sift motor drive signal is finished. Therefore, the number of pulses of the shift motor drive signal has been counted when start of movement of the shift unit 108 is detected by the linear encoder sensor 170 (the time t1), the CPU 501 can detect the count value as the number of response delay pulses Pd1.

The CPU 501 then determines whether or not the side edge sensor 104 has been turned off (step S23). When, as a result of the determination, the side edge sensor 104 has not been turned off, the CPU 501 waits until the side edge sensor 104 is turned off (step S23). On the other hand, when the side edge sensor 104 has been turned off, the CPU 501 moves the shift unit 108 by outputting the shift motor drive signal whose number of pulses is obtained by subtracting the number of response delay pulses Pd1 from a predetermined number of pulses Pb is output and then stops outputting the shift motor drive signal (stops driving) to stop the shift unit 108 (step S24). Thereafter, the CPU 501 terminates the sheet moving process in which it moves the sheet S to the punching position.

While the sheet moving process in which it moves the sheet S to the punching position is being carried out, the side edge sensor 104 is standing by at the second predetermined position (see the step S6 in FIG. 6A described above). Thus, a time point when the side edge sensor 104 switches from the on state to the off state (a time t2 in FIG. 10) is a time point when the side edge of the sheet S on the rear side reaches the second predetermined position Y2 according to movement of the shift unit 108. A position at which movement of the sheet S is to be stopped (target stop position) is the first predetermined position Y1, and the distance between the second predetermined position Y2 and the first predetermined position Y1 is fixed at the predetermined distance α, and therefore, the number of pulses required to move the sheet S the predetermined distance α from the time t2 can be calculated with ease. The calculated number of pulses is "the predetermined number of pulses Pb" in the step S24 ("the number of pulses between from a time t2 to a time t4" in FIG. 10A).

A total number of pulses Pt is obtained by adding the number of pulses of the shift motor drive signal output from the time t0 to the time t2 to the predetermined number of pulses Pb. The total number of pulses Pt represents a total number of pulses of the shift motor drive signal supplied to the shift motor 210 in a case where the shift unit 108 starts operating immediately after output of the shift motor drive signal to the shift motor 210 is started, that is, without response delay. Actually, however, the shift unit 108 never starts operating without response delay. This is because under the effect of inertia due to the weight of the shift unit 108, the drive belt 211 expands when shift unit 108 starts operating. The overall length of the drive belt 211 never varies while being at rest, and hence when the shift unit 108 stops, the drive belt 211 contracts by the amount by which the driving belt 211 expanded. Therefore, the number of response delay pulses when the shift unit 108 starts operating and the number of response delay pulses when the shift unit 108 stops operating are equal and Pd1. Namely, when the shift motor drive signal with pulses corresponding to the total number of pulses Pt is supplied to the shift motor 210, the shift unit 108 goes beyond the target stop position by a distance corresponding to the number of response delay pulses Pd1 and stops as shown in FIG. 10A.

Accordingly, in the present embodiment, at the time point when the side edge sensor 104 switches from the off state to the on state or later, the shift motor drive signal whose number of pulses is obtained by subtracting the number of response delay pulses Pd1 from the predetermined number of pulses Pb supplied by the conventional finisher (=Pb−Pd1) is supplied to the shift motor 210. As a result, as shown in FIG. 10B, the shift unit 108 stops at the target stop position. FIG. 9C shows a position of the shift unit 108 after the sheet moving process in which it moves the sheet S to the punching position, and as shown in FIG. 9C, the sheet S is precisely positioned with the first predetermined position Y1.

Referring again to FIG. 6B, the CPU 501 performs punching on the sheet S (step S11) and then resumes conveying the sheet S (step S12).

The CPU 501 moves the side edge sensor 104 to the first predetermined position Y1 (step S13) and determines whether or not a trailing edge of the sheet S has passed the shift unit 108 (step S14). When, as a result of the determination, the trailing edge of the sheet S has not passed the shift unit 108, the CPU 501 waits until the trailing edge of the sheet S has passed the shift unit 108 (step S14). On the other hand, when the trailing edge of the sheet S has passed the shift unit 108, the CPU 510 causes the shift unit 108 to move to the predefined position and stand by (step S15), and thereafter, terminates the punching job process.

As described above, in the present embodiment, a difference between the travel amount of the shift unit 108 calculated from the shift motor drive signal and the travel amount of the shift unit 108 actually moved, that is, a difference arising from a response delay occurring when the shift unit 108 starts operating can be eliminated. As a result, even when the sheet is moved by the shift unit 108 which is heavy in weight, the sheet can be stopped at the target position with precision.

Moreover, because in the present embodiment, the side edge of the sheet S is detected twice by moving the side edge sensor 104 and the shift unit 108, and two corrections are performed based on the respective detection results, the sheet can be registered with higher precision. Further, because immediately before stopping at the punching position, the shift unit 108 always moves in one direction (in the present embodiment, from the rear side toward the front side), variations in the positions at which the shift unit 108 stops according to moving directions can be reduced.

An image forming system according to a second embodiment of the present invention differs from the image forming system according to the first embodiment described above in a part of the punching job process, and more specifically, the sheet moving process in which the sheet is moved to the punching position. Therefore, hardware of the image forming system according to the first embodiment, that is, hardware shown in FIGS. 1 to 5 is used as it is as hardware of the image forming system according to the second embodiment.

In the first embodiment, a response delay resulting from expansion of the drive belt 211 of the shift unit 108 is eliminated when the shift unit 108 stops. Namely, in the first embodiment, the drive belt 211 that has expanded does not contract during movement of the shift unit 108, but contracts when the shift unit 108 stops. On the other hand, in the present embodiment, elimination of a response delay resulting from expansion of the drive belt 211 is started when the shift motor 210 is operating. Namely, in the present embodiment, part of the drive belt 211 that has expanded partially contracts even when the shift unit 108 is moving.

Figure 11:
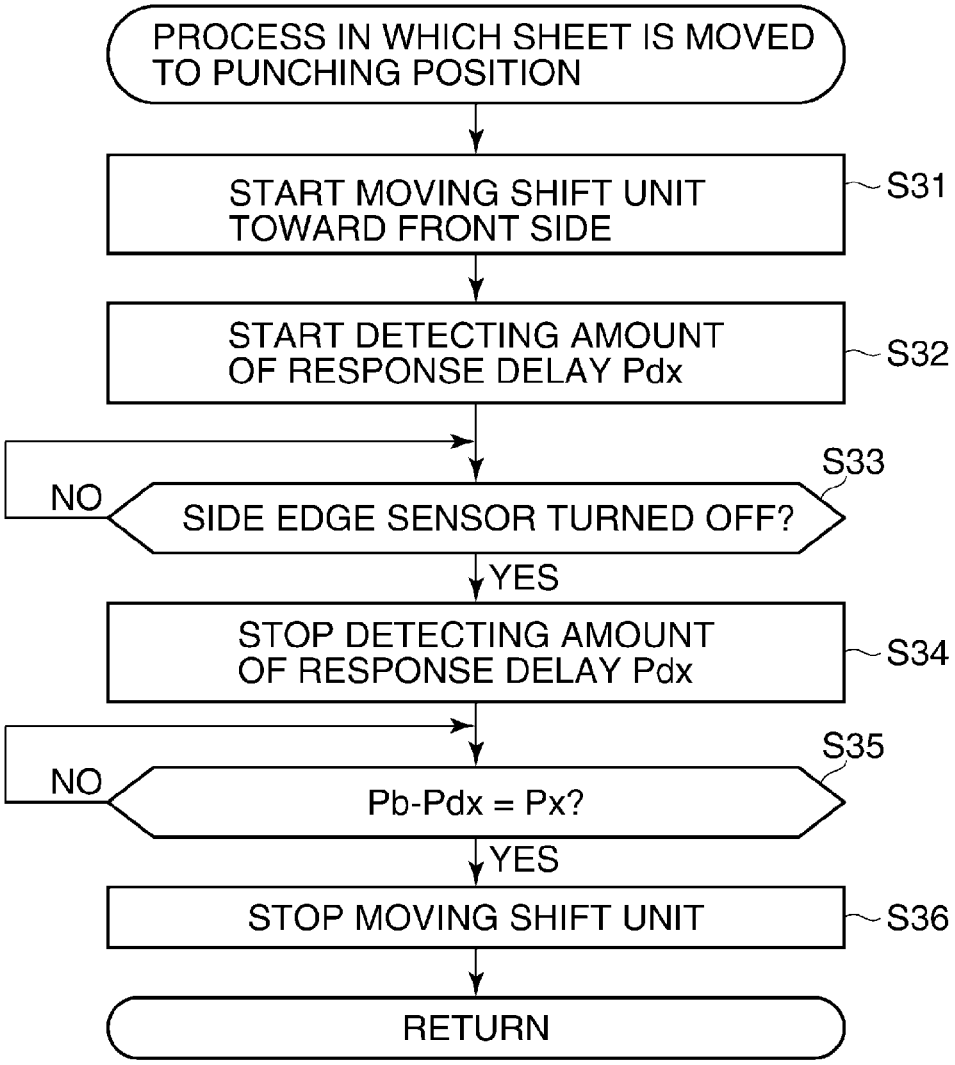
FIG. 11 is a flowchart showing in detail the procedure of a sheet moving process in which a sheet is moved to a punching process position by a finisher according to a second embodiment, and more particularly by a CPU of a finisher controller.

FIG. 11 is a flowchart showing in detail the procedure of the process in which the sheet is moved to the punching position by the finisher 100 according to the present embodiment, and more particularly by the CPU 510 of the finisher controller 501. It should be noted that the punching job process used in the first embodiment, that is, the punching job process in FIGS. 6A and 6B is adopted as it is as a punching job process that calls the process in which the sheet is moved to the punching position.

Referring to FIG. 11, first, the CPU 510 starts outputting the shift motor drive signal to the shift motor 210 (starts driving), thus causing the shift unit 108 to start moving toward the front side (step S31). As a result, the sheet S starts moving toward the front side. However, even when instructed to start moving, the shift unit 108 does not immediately start moving under the effect of inertia due to weight, but starts moving after elapse of a predetermined delay time, and hence the sheet S as well starts moving after elapse of the predetermined delay time. Here, the predetermined delay time is equal to the predetermined delay time (in FIG. 10, the time t0-t1) in the first embodiment described above.

Figure 12:
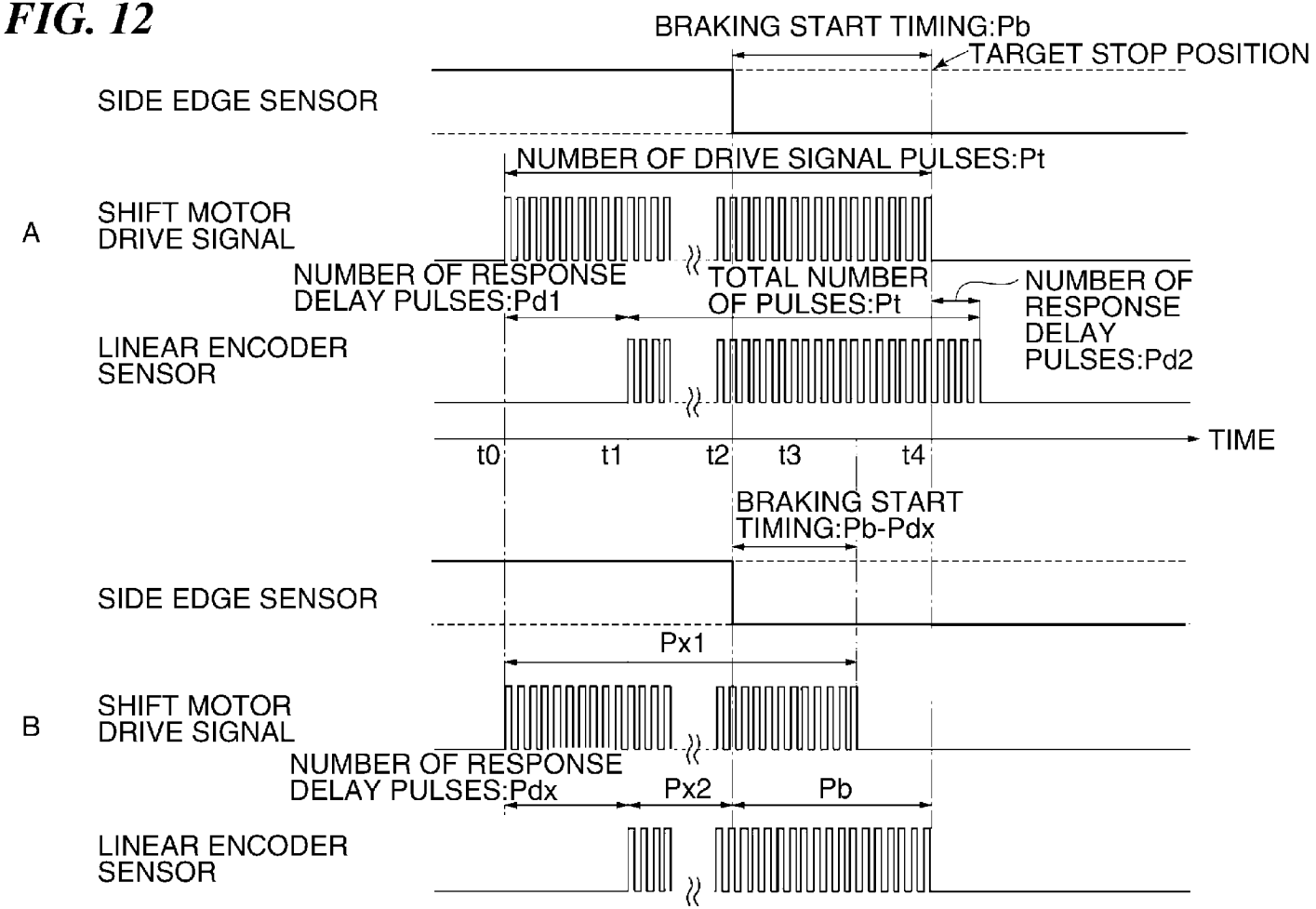
FIG. 12 is a timing chart showing timing with which a shift motor drive signal is output according to the second embodiment.

FIG. 12 is a timing chart showing timing with which the shift motor drive signal is output and corresponds to FIG. 10 showing the first embodiment. Therefore, in FIG. 12, the same elements as those in FIG. 10 are designated by the same symbols. Also, in FIG. 12 as well, timing with which a conventional finisher outputs the shift motor drive signal (FIG. 12A) as well as timing with which the finisher 100 according to the present embodiment outputs the shift motor drive signal (FIG. 12B) is shown. In FIG. 12, output of the shift motor drive signal is started at a time t0.

Referring again to FIG. 11, the CPU 501 starts calculating a difference between the number of pulses Px1 from when output of the shift motor drive signal is started and the number of pulses Px2 from when the linear encoder sensor 170 starts sensor output, that is, the number of response delay pulses Pdx (step S32). Here, in the present embodiment as well, the period of the shift motor drive signal and the period of the sensor output signal from the linear encoder sensor 170 are equal to each other as with the first embodiment, and hence the number of response delay pulses Pdx is calculated according to the following equation, Pdx=Px1−Px2. If the periods are different, the period of one is converted into the period of the other one, and then a difference between them should be calculated. It should be noted that after the linear encoder sensor 170 starts sensor output, the CPU 501 counts the number of pulses of sensor output until sensor output is completed in addition to counting the number of pulses of the shift motor drive signal.

The CPU 501 then determines whether or not the side edge sensor 104 has been turned off (step S33). When, as a result of the determination, the side edge sensor 104 has not been turned off, the CPU 501 waits until the side edge sensor 104 is turned off (step S33). On the other hand, when the side edge sensor 104 has been turned off, the CPU 501 (second detection unit) finishes calculating the number of response delay pulses Pdx (step S34).

The CPU 510 then starts counting the number of pulses Px of the shift motor drive signal from a time point when the side edge sensor 104 was turned off, and waits until Pdx=Px1−Px2 is satisfied (step S35). Here, the number of pulses Pb is the number of predetermined pulses Pb in the first embodiment described above.

When Pdx=Px1−Px2 is satisfied, the CPU 510 stops outputting the shift motor drive signal (stops driving) to stop the shift unit 108 (step S36).

As shown in FIG. 12A, a response delay corresponding to the number of response delay pulses Pd1 occurs from when output of the shift motor drive signal is started to when the shift motor unit 108 actually starts moving. Also, a response delay corresponding to the number of response delay pulses Pd2 occurs from when output of the shift motor drive signal is stopped to when the shift motor unit 108 stops. However, as described above, it is assumed that the drive belt 211 that expands when the shift unit 108 starts operating partially contracts during movement of the shift unit 108, and hence elimination of the response delay is started during movement of the shift unit 108. As a result, the amount of response delay Pd1 when the shift unit 108 starts operating and the amount of response delay Pd2 when the shift unit 108 stops are not equal, and their relationship is represented by Pd1>Pd2. Therefore, in this case, the shift unit 108 stops at a position shifted from the target stop position by a distance corresponding to the amount of response delay Pd2.

In the time chart of FIG. 12B as well, as with the chart of FIG. 12A, a response delay corresponding to the number of response delay pulses Pd1 occurs when the shift unit 108 starts operating (time t1). However, elimination of this response delay is started when the shift unit 108 starts moving, and hence as the distance travelled by the shift unit 108 increases, the amount of response delay decreases. For this reason, the amount of response delay pulses Pdx at a time point when the side edge sensor 104 detects the side edge of the sheet S is different from the amount of response delay Pd1. In the present embodiment, it is assumed that the amount of response delay Pdx is kept until the shift unit 108 stops.

For this reason, the amount of response delay Pdx is fed back to timing with which the shift unit 108 is stopped, and timing with which the shift unit 108 is stopped is determined. Specifically, it is assumed that after instructed to stop, the shift unit 108 moves only a predetermined distance (distance corresponding to the number of response delay pulses Pdx), and at a time point when the side edge sensor 104 switches from the on state to the off state or later, the shift motor drive signal with pulses corresponding in number to the number of pulses obtained by subtracting the number of response delay pulses Pdx from the predetermined number of pulses Pb (=Pb−Pdx) is supplied to the shift motor 210. As a result, as shown in FIG. 12B, the shift unit 108 stops at the target stop position.

Thus, in the present embodiment as well, a difference between the travel amount of the shift unit 108 calculated from the shift motor drive signal and the travel amount of the shift unit 108 actually moved, that is, a difference arising from a response delay occurring when the shift unit 108 starts operating can be eliminated. As a result, even when the sheet is moved by the shift unit 108 which is heavy in weight, the sheet can be stopped at the target position with precision.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-107465, filed May 9, 2012, and No. 2013-093780, filed Apr. 26, 2013, which are hereby incorporated by reference herein in their entirety.

What is claimed is:

1. A sheet processing apparatus comprising:

a first detection unit configured to detect a position of a side edge of a sheet in a width direction perpendicular to a conveying direction of the sheet;

a moving unit configured to hold the sheet and move the sheet in the width direction;

a motor configured to move said moving unit in the width direction via a driving force transmitting member;

a second detection unit configured to detect movement of said moving unit; and a control unit configured to control a drive of said motor based on the position detected by said first detection unit so that the side edge of the sheet moves to a reference position in the width direction, and determine timing with which the driving of said motor should be stopped based on a drive amount of said motor from when said motor start driving until when said second detection unit detects that said moving unit starts driving.

2. A sheet processing apparatus according to claim 1, wherein said control unit generates drive pulses for driving said motor and determines timing with which said motor should be stop driving based on a first number of drive pulses generated from when said control unit starts generating the drive pulses until when said second detection unit detects that said moving unit starts moving.

3. A sheet processing apparatus according to claim 2, wherein said control unit determines a second number of drive pulse required to move said moving unit by a distance between the position of the side edge of the sheet detected by said first detection unit and the reference position, and stops generating the drive pulses after said control unit generates the drive pulses whose number is obtained by subscribing the second number from the first number.

4. A sheet processing apparatus according to claim 1, said second detection unit includes a pulse encoder provided in said moving unit.

5. A sheet processing apparatus according to claim 1, wherein the driving force transmitting member is a belt.

* * * * *